United States Patent [19]

Nagira

[11] Patent Number: 4,822,019

[45] Date of Patent: Apr. 18, 1989

[54] ELECTRONIC EQUIPMENT UTILIZING FORWARD/REVERSE ROTATION OF MOTOR

[75] Inventor: Keiji Nagira, Kawasaki, Japan

[73] Assignee: Canon Kabushiki Kaisha, Tokyo, Japan

[21] Appl. No.: 68,792

[22] Filed: Jul. 2, 1987

Related U.S. Application Data

[63] Continuation of Ser. No. 706,130, Feb. 26, 1985, abandoned.

[30] Foreign Application Priority Data

Mar. 2, 1984 [JP] Japan ..... 59-38701

[51] Int. Cl.[4] ..... B65H 3/44; H02P 8/00

[52] U.S. Cl. ..... 271/9; 271/110; 271/114; 271/258; 400/624; 318/696

[58] Field of Search ..... 271/9, 110, 111, 114, 271/116, 162, 164, 225, 256, 258, 259, 265; 400/624, 625, 629; 318/571, 608, 685, 696

[56] References Cited

U.S. PATENT DOCUMENTS

| | | | |
|---|---|---|---|
| 3,965,406 | 6/1976 | Yablonski | 318/696 |
| 4,025,187 | 5/1977 | Taylor et al. | 271/34 |
| 4,084,805 | 4/1978 | Simpson | 271/9 |
| 4,271,773 | 6/1981 | Makabe | 112/158 |
| 4,438,915 | 3/1984 | Akamatsu et al. | 271/9 |
| 4,555,653 | 11/1985 | Nawata et al. | 318/685 X |
| 4,626,758 | 12/1986 | Takeuchi et al. | 318/696 X |
| 4,706,008 | 11/1987 | Cronch et al. | 318/696 |
| 4,707,649 | 11/1987 | Kanemura | 318/685 |

FOREIGN PATENT DOCUMENTS

| | | | |
|---|---|---|---|
| 49-82412 | 8/1974 | Japan . | |
| 56-38988 | 9/1981 | Japan . | |
| 2069467 | 8/1985 | United Kingdom | 271/9 |

*Primary Examiner*—Joseph J. Rolla
*Assistant Examiner*—Edward S. Ammeen
*Attorney, Agent, or Firm*—Fitzpatrick, Cella, Harper & Scinto

[57] ABSTRACT

A cut sheet feeder feeds out a cut sheet from a first paper cassette when a bidirectional pulse motor for driving paper feed rollers rotates forward and from a second paper cassette when the bidirectional pulse motor rotates reversely, and can suppress feed-out of the cut sheet from the wrong paper cassette when the pulse motor starts to rotate. The feeding of the cut sheet from the wrong paper cassette is suppressed by stopping the motor at a predetermined phase. A first memory stores the predetermined phase and a second memory stores the current phase. A controller compares the contents of the first and second memories and applies a drive pulse to the motor until the contents of the memories coincide. A loop is formed in the cut sheet prior to the comparison of the contents of the memories to permit the motor to be rotated in the proper direction.

6 Claims, 5 Drawing Sheets

ELECTRONIC EQUIPMENT UTILIZING FORWARD/REVERSE ROTATION OF MOTOR

This application is a continuation of application Ser. No. 706,130, filed Feb. 26, 1985, now abandoned.

BACKGROUND OF THE INVENTION

1. Field of the Invention

The present invention relates to an electronic apparatus which drives different operation systems by forward/reverse rotation of a motor.

2. Description of the Prior Art

There are many types of equipment which drive different operation systems by utilizing the forward-/reverse rotation of the motor.

For example, in a cut sheet feeder of a printer for a word processor, electronic typewriter, facsimile machine or other electronic equipment, a paper feeder having a bidirectional motor and a paper feed roller coupled to the motor and vertically swingable, arranged between upper and lower paper cassettes is used. A pulse motor is frequently used as the bidirectional motor. The pulse motor may rotate, by its nature, in the opposite direction to the designated direction when it starts to rotate. This is disadvantageous to the paper feed. For example, a cut sheet in the wrong paper cassette may be fed by a small distance when the motor starts to rotate. As these small feed distances accumulate, the cut sheet is eventually fed out of the cassette by a large amount. If printing is eventually performed on such partially fed cut sheet, the print start position may be significantly shifted or the paper may be jammed.

SUMMARY OF THE INVENTION

It is an object of the present invention to eliminate the difficulties heretofore encountered when a pulse motor starts to rotate.

It is an object of the present invention to feed a cut sheet by an exact distance when the cut sheet is fed from first or second accommodation means to a platen.

It is another object of the present invention to prevent an improper cut sheet from being fed out when a motor starts to rotate.

Other objects of the present invention will be apparent from the following description of the invention.

DETAILED DESCRIPTION OF THE PREFERRED EMBODIMENTS

Figure 1:
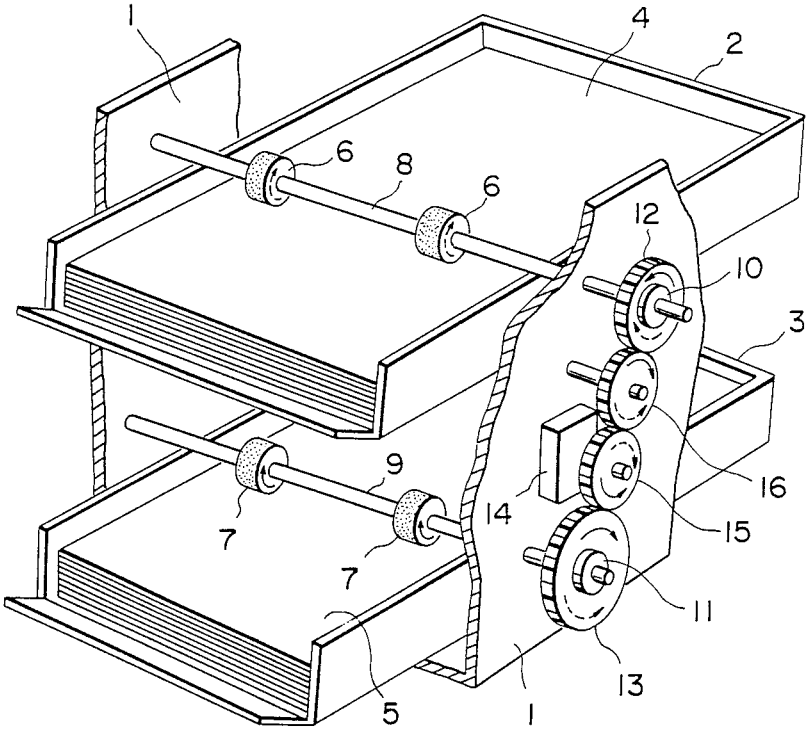
FIG. 1 is a perspective view, partly cut away, of one embodiment of a cut sheet feeder of the present invention.

Referring to FIG. 1, a mechanism of a cut sheet feeder for selecting a paper feed roller in accordance with a direction of rotation of a bidirectional paper feed motor is explained. Numeral 1 denotes an outer case which is partially shown, numerals 2 and 3 denote upper and lower paper cassettes for accommodating cut sheet, which are removably loaded to predetermined positions in the outer case 1, numerals 4 and 5 denote cut sheets stacked in the paper cassettes 2 and 3, and numerals 6 and 7 denote paper feed rollers for feeding out the cut sheets, which are resiliently contacted to the tops of the cut sheets 4 and 5. As the paper feed rollers 6 and 7 are driven in directions shown by arrows, the cut sheets 4 or 5 are fed out, one at a time, by a friction force of the cut sheets 4 or 5 and the paper feed rollers 6 or 7. Numerals 8 and 9 denote paper feed roller shafts having opposite ends thereof rotatably supported by the outer case 1. Numerals 10 and 11 denote one-way clutches mounted at the ends of the paper feed roller shafts 8 and 9 to transmit only the rotations in the paper feed direction. Numerals 12 and 13 denote gears which are mounted on the paper feed roller shafts 8 and 9 through the one-way clutches 10 and 11. Numeral 14 denotes a paper feed motor which is a bidirectional pulse motor and mounted on the outer case 1 between the upper and lower paper cassettes 2 and 3. Numeral 15 denotes a motor gear which is fixed to an output shaft of the paper feed motor 14 (through a reduction gear or directly). Numeral 16 denotes an intermediate gear which is rotatably mounted on the outer case 1. The motor gear 15 is meshed with the gear 13 of the lower paper cassette 3 directly or through one stage of gears and meshed with the gear 12 of the upper paper cassette 2 through the intermediate gear 16 or through two stages of gears. The cut sheets 4 and 5 may be white papers or unrecorded papers for a printer or original sheets or printed or recorded papers for a facsimile machine. The sizes and the thicknesses of the cut sheets 4 and 5 may be equal to or different from each other.

In operation, as the paper feed motor 14 which is the pulse motor is rotated in the predetermined direction to drive the motor gear 15 in the solid arrow direction, the gear 13 meshed therewith is rotated in the solid arrow direction, that is, in the paper feed direction. Accordingly, the paper feed roller 7 is rotated through the one-way clutch 11 so that the cut sheet 5 is fed out of the lower paper cassette 3. On the other hand, the intermediate gear 16 and the upper gear 12 are also rotated in the solid arrow directions. Since the gear 12 is rotated in the opposite direction to the paper feed direction, the one-way clutch 10 is not active and the upper paper feed roller 6 is not rotated so that the cut sheet 4 is not fed out. When the paper feed motor 14 is rotated in the opposite direction to rotate the motor gear 15 in the chain arrow direction, the upper gear 12 is rotated in the paper feed direction shown by the chain arrow through the intermediate gear 16 so that the one-way clutch 10 is activated and the upper paper feed roller 6 is rotated to feed out the cut sheet 4. On the other hand, the lower gear 13 is rotated in the counter-feed direction shown by the chain arrow so that the one-way clutch 11 is not active, the lower paper feed roller 7 is not rotated, the cut sheet 5 is not fed out and the proper selection of the paper feed roller is attained.

In the present embodiment, the paper feed motor 14 is used as a motive force source and the motor gear 15, one-way clutch 11, gear 13, intermediate gear 16, one-way clutch 10 and gear 12 form means for driving the paper feed rollers 6 and 7. The gear 13, one-way clutch 11 and paper feed roller form a first drive system, and the intermediate gear 16, one-way clutch 10, gear 12 and paper feed roller 6 form a second drive system.

Figure 2:
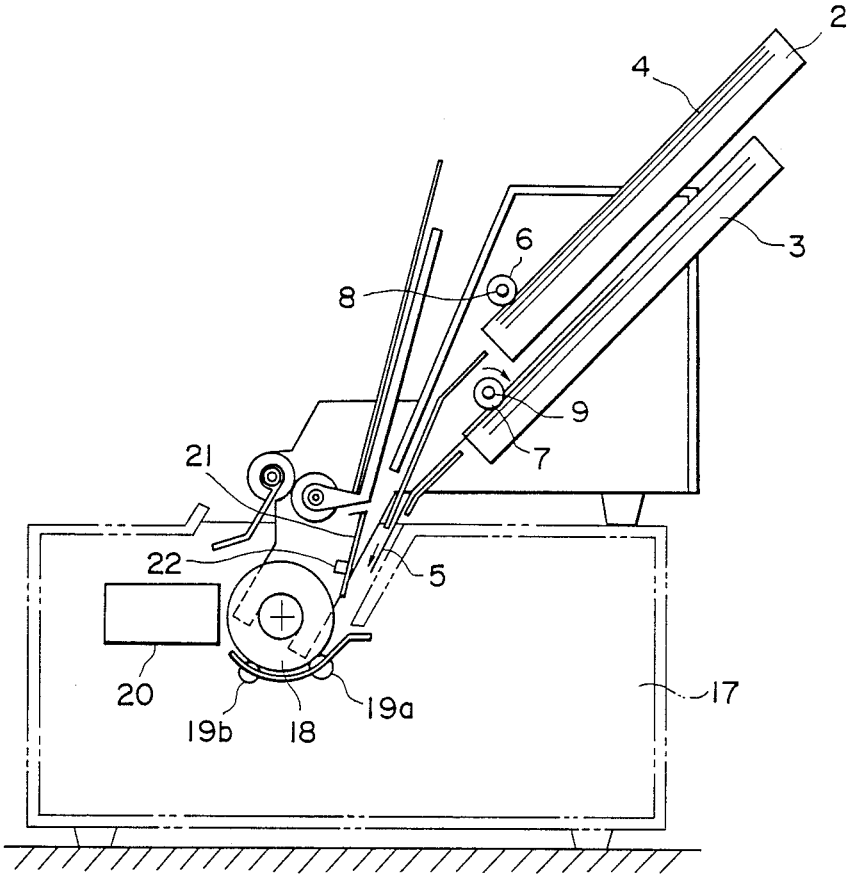
FIGS. 2 and 3 show sectional views of the cut sheet feeder mounted on a printer.
Figure 3:
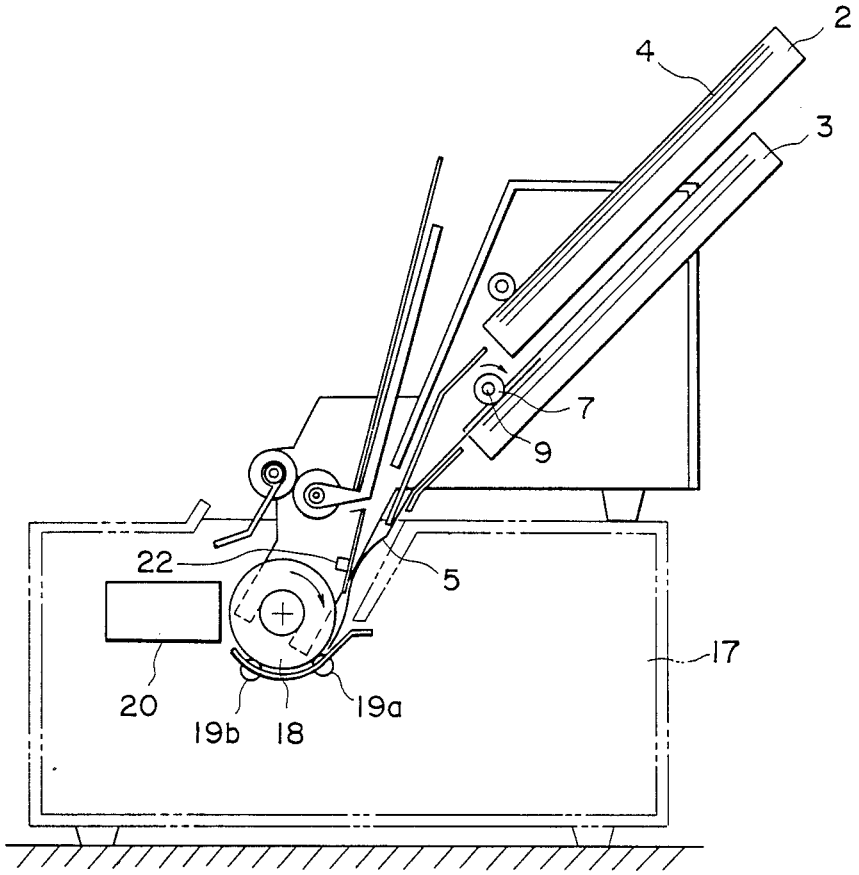

FIGS. 2 and 3 show the cut sheet feeder of the present invention mounted on a printer to feed papers. The cut sheet feeder and the printer are electrically connected through a pluggable cable not shown. Both units have control circuits to exchange signals so that both units are operated in optimum conditions to construct a cut sheet conveying system.

Numeral 17 denotes the printers, numeral 18 denotes a platen mounted in the printer 17, numerals 19*a* and 19*b* denote pinch rollers contacted to the periphery of the platen 18 and pressed thereagainst with an appropriate pressure, numeral 20 denotes a print (record) head of the printer 17, numeral 21 denotes a guide plate arranged in a feed path of the cut sheet 5, and numeral 22 denotes a sensor fixed to the guide plate 21 for sensing the passage of a leading edge of the cut sheet 5. The sensor 22 may be a photo-sensor which senses a light reflected from the paper. As the paper feed motor 14 is rotated to rotate the paper feed roller 7 in the solid arrow direction and feed the cut sheet 5 of the paper cassette 3 in the solid arrow direction, the leading edge of the cut sheet 5 passes through the sensor 22 mounted on the guide plate 21. In FIG. 3, the leading edge of the cut sheet 5 has passed through the sensor 22 and the paper feed motor 14 has been rotated by a predetermined rotation angle (determined by a preset number of pulses) and then stopped. Under this condition, the leading edge of the cut sheet 5 abuts against the engaging area of the platen 18 and the pinch roller 19*a* and the forward movement of the cut sheet 5 is restrained so that the cut sheet 5 is looped and the rotation of the paper feed motor 14 is temporarily stopped. As the platen 18 of the printer 17 is rotated in the solid arrow direction, the cut sheet 5 is held by the platen 18 and the pinch rollers 19*a* and 19*b* and fed toward the record head 20. The paper feed roller 7 is rotated for a moment in the solid arrow direction as the cut sheet 5 is pulled in by the platen 18. However, this movement is not transmitted due to the one-way clutch 11 mounted on the paper feed roller shaft 9, and the gear 13 shown in FIG. 1 is not rotated. Accordingly, the motor gear 15, intermediate gear 16, gear 12 and paper feed motor 14 are not rotated. Because the phase of the paper feed motor (pulse motor) 14 when the leading edge of the cut sheet 5 passes through the sensor 22 is not constant because of variations in the slip when the sheet is separated and the direction precision of the sensor 22, the paper feed motor 14 does not stop at a constant phase. A distance from the cut sheet 4 to the platen 18 or the sensor 22 when the cut sheet 4 is fed out of the upper paper cassette 2 is different from a distance from the cut sheet 5 to the platen 18 or the sensor 22 when the cut sheet 5 is fed out of the lower paper cassette 3, and the paper feed motor does not necessarily stop at the same phase in both cases. In order to resolve the above problem, in accordance with the cut sheet feeder of the present embodiment, when the paper is fed by the platen drive of the printer 17, the paper feed motor (pulse motor) 14 which was temporarily stopped is rotated (from a source, and not from the feed roller movement) in the paper feed direction to a predetermined phase and stopped at that phase.

Figure 4:
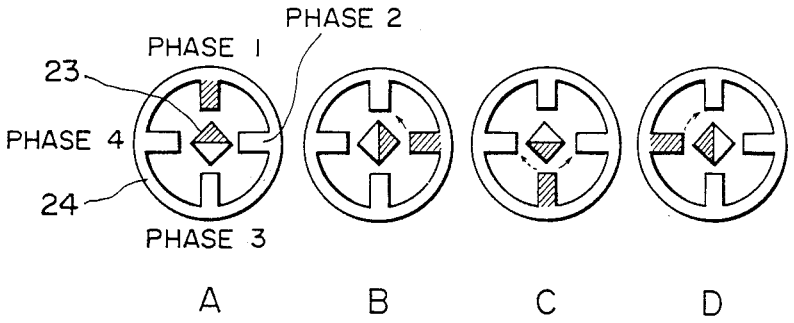
FIG. 4 shows a sectional view for explaining an operation of a paper feed motor (pulse motor).

Referring to FIG. 4, a rotation phase and a stop phase of the paper feed motor 14 used in the cut sheet feeder of the present invention are explained. FIG. 4 is a sectional view of the paper feed motor (pulse motor) 14 in which numeral 23 denotes a rotor and numeral 24 denotes a stator. In FIG. 4A, the motor is stopped at phase 1, in FIG. 4B, the motor is stopped at phase 2, in FIG. 4C, the motor is stopped at phase 3, and in FIG. 4D, the motor is stopped at phase 4. The paper feed motor (pulse motor) 14 is driven in phase 1→ phase 2→ phase 3→ phase 4 in a forward drive mode, and in phase 1→ phase 4→ phase 3→ phase 2 in a reverse drive mode. In FIG. 4A (stopped at the phase 1), the rotor 23 starts to rotate from the present position when it is next driven. In FIG. 4B (stopped at the phase 2), the rotor 23 rotates in the solid arrow direction and starts normal rotation from the phase 1 position. In FIG. 4C (stopped at the phase 3), the rotor 23 rotates in the solid arrow direction or broken arrow direction and starts normal rotation from the phase 1 position. In FIG. 4D (stopped at the phase 4), the rotor 23 rotates in the broken arrow direction and starts normal rotation from the phase 1 position. In FIGS. 4B, 4C and 4D, if the direction of rotation before the normal rotation is the same as the direction of paper feed expected, no problem arises. However, if the rotation is in the opposite direction, the cut sheet in the opposite paper cassette is fed out as the rotor is rotated. In the present embodiment, it is therefore necessary to stop the paper feed motor (pulse motor) 14 at the predetermined phase before the next forward or reverse drive of the motor is started. To this end, a proper loop is formed in the paper, the paper feed motor 14 is temporarily stopped, then the platen 18 of the printer 17 is driven to feed the paper. In this case, the platen 18 and the pinch rollers 19*a* and 19*b* hold the cut sheet 5 and the paper feed motor 14 is rotated in the paper feed direction to the predetermined phase (e.g. phase 1) and stopped at that phase and the motor 14 waits for the next drive. By setting the paper feed distance by four phases of the paper feed motor 14 to be smaller than the loop, the paper feed by the platen is not affected. If the feed distance of the cut sheet of the cut sheet feeder is smaller than the feed distance by the platen, the chance of problem is much less.

Figure 5:
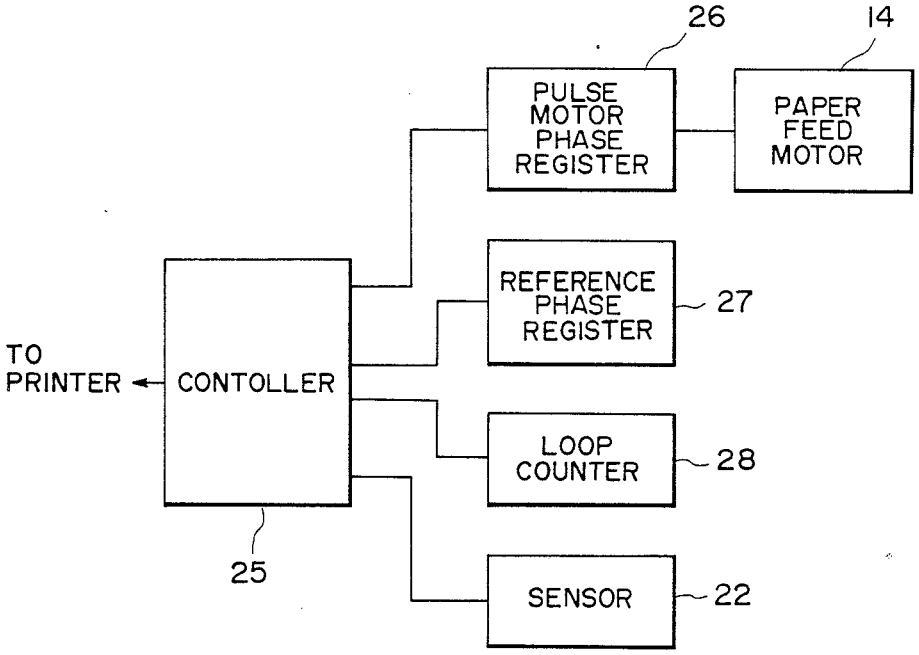
FIG. 5 is a block diagram of a control circuit.
Figure 6:
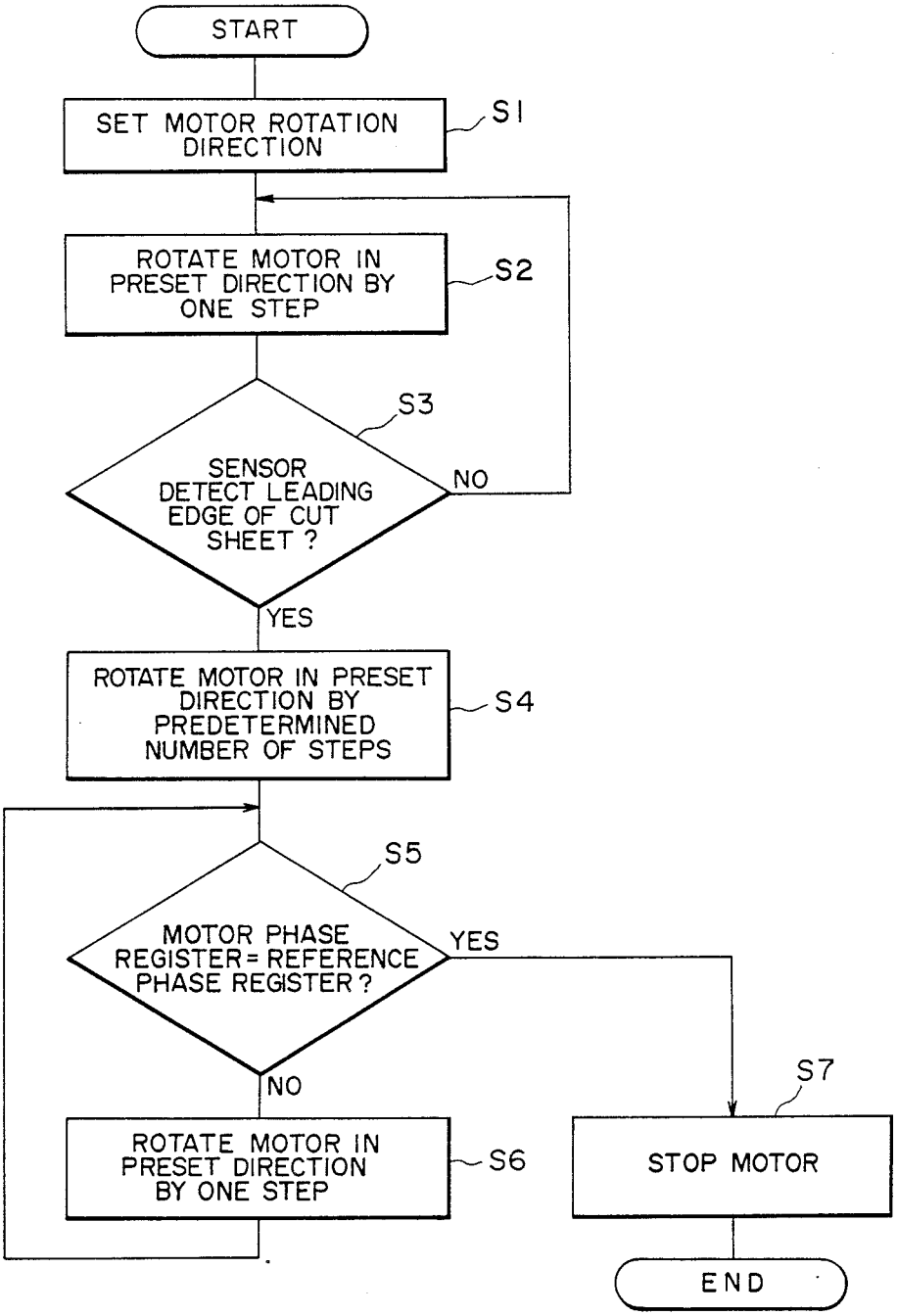
FIG. 6 is a flow chart.

Referring to a block diagram of the cut sheet feeder shown in FIG. 5 and a flow chart of FIG. 6, a control for the above operation is now explained.

In a stop S1, the printer instructs the rotation direction of the paper feed motor 14, that is, it designates the paper cassette from which the cut sheet is to be fed out. It may be instructed by a selection switch in the cut sheet feeder. In order to rotate the paper feed motor in the instructed direction, a controller 25 in the cut sheet feeder applies one drive pulse to the motor through a pulse phase register 26. In a step S3, whether the sensor 22 has detected the leading edge of the cut sheet or not is checked, and the motor 14 is rotated until the sensor 22 detects the leading edge. If it detects, the controller 25 feeds, in a step S4, the paper by a predetermined number of steps in accordance with a content of a counter 28 to form a predetermined loop. The controller 25 decrements the loop counter 28 by one each time the paper is fed one step. When the content of the loop counter 28 reaches zero, the controller 25 compares, in a step S5, a content of a reference phase register 27 and a content of a pulse motor phase register 26. The reference phase register 27 stores the predetermined phase at which the pulse motor 14 is to be stopped. The pulse motor phase register 26 contains the currently excited phase of the pulse motor 14. If both contents are not equal, the controller 25 drives, in steps S5 and S6, the pulse motor 14 until the content of the pulse motor phase register 26 reaches the content of the reference phase register 27. When both contents are equal, the pulse motor 14 is stopped at a step S7.

In a two-phase excitation, the content of the pulse motor phase register 26 reaches the content of the reference phase register 27 in these steps at most.

When both contents are equal, the controller 25 holds the content of the pulse motor phase register 26, stops the pulse motor 14 and waits for the next paper feed. In the above explanation, the motor is driven by the predetermined number of pulses after the paper passed through the sensor 22 to form the loop. If the sensor 22 is not provided and the motor is to be driven by a predetermined rotation angle, the paper feed motor (pulse motor) 14 may be stopped at the same phase and wait for the next paper feed. In the present embodiment, an odd number of gears and the one-way clutch 11 are combined to drive the upper and lower paper feed rollers 6 and 7. Accordingly, the cut sheets can be fed out of two paper cassettes (double cassette) by only one bidirectional paper feed motor (pulse motor) 14. Since the cut sheets in the upper and lower paper cassettes are fed by only one paper feed motor (pulse motor) 14, the construction is relatively simple and manufacturing cost can be reduced. The switching of the paper feed rollers required in the prior art is not necessary and the paper feed control is attained only by the forward/reverse control of the paper feed motor 14. Thus, exact and reliable paper feed is attained. Since the paper feed rollers 6 and 7 contact the tops of the stacked cut sheets 4 and 5 in the upper and lower paper cassettes to feed out the cut sheets from the tops, the papers are fed stably. The paper cassettes 2 and 3 need not be rigidly arranged and may be loaded horizontally or slightly obliquely as shown in FIGS. 1, 2 and 3. Accordingly, even thin cut sheets can be fed stably.

In the present embodiment, the leading edges of the cut sheets fed from both paper cassettes are detected by one sensor 22 and the feed distance is determined based on it. Accordingly, both cut sheets can form proper loops relative to the platen.

In the above embodiment, the paper feed cassettes 2 and 3 are vertically arranged. If required, they may be arranged horizontally or diagonally. In the embodiment shown in FIG. 1, an even number (two) of gears are provided for the upper cassette and an odd number (one) of gear is provided for the lower cassette. Those numbers may be opposite. Intermediate gears may be appropriately arranged so that larger number of gears may be used.

The cut sheet feeder of the present invention is applicable to feed the stacked sheets such as blank papers, original sheets or printed documents. Accordingly, it is applicable not only to a printer and recorder but also to a facsimile and computer. It is further applicable to any electronic apparatus which drives two operation systems by bidirectionally driving the pulse motor.

What is claimed is:

1. An electronic apparatus comprising:

a first operation system;

a second operation system;

a pulse motor having multiple excitation phases and being repeatedly rotatable through the multiple excitation phases in forward and reverse directions selectively in response to the sequential application of drive pulses to the excitation phase;

transmission means for transmitting forward rotation of said pulse motor to said first operation system and reverse rotation of said pulse motor to said second operation system;

first memory means for storing a predetermined excitation phase of said pulse motor;

second memory means responsive to the drive pulses for storing a current excitation phase of said pulse motor; and control means for sequentially applying the drive pulses to the excitation phases of said pulse motor, beginning with the predetermined excitation phase, to cause said pulse motor to rotate in a desired direction and for comparing the contents of said first and second memory means at the cessation of the application of the drive pulses to said pulse motor, wherein if the contents of said first and second memory means fail to coincide, said control means applies additional drive pulses to said pulse motor to cause further rotation of said pulse motor in the desired direction until the contents of said first and second memory means coincide.

2. An electronic apparatus according to claim 1 further comprising first and second accommodation means for accommodating cut sheets therein and wherein said first operation system includes first paper feed means for feeding out cut sheets stacked in said first accommodation means, and said second operation system includes second paper feed means for feeding out cut sheets stacked in said second accommodation means.

3. An electronic apparatus according to claim 2 further comprising guide means for guiding the cut sheet fed out of said first or second accommodation means to a platen arranged to face a print head.

4. An electronic apparatus according to claim 3 further comprising detection means arranged adjacent to said guide means for detecting a leading edge of the cut sheet.

5. An electronic apparatus according to claim 1 wherein said transmission means comprises:

first one way clutch means for transmitting the forward rotation of said pulse motor to said first operation system; and second one way clutch means for transmitting the reverse rotation of said pulse motor to said second operation system.

6. A cut sheet feeder comprising:

first and second accommodation means for accommodating cut sheets therein;

feed means for selectively feeding out a cut sheet from said first or second accommodation means;

motive means including a bidirectional pulse motor having multiple excitation phases and being repeatedly rotatable through the multiple excitation phases by application thereto of sequential drive pulses for causing said feed means alternatively to feed out a cut sheet from said first accommodation means when said pulse motor is rotated in a forward direction and causing said feed means to feed out a cut sheet from said second accommodation means when said pulse motor is rotated in a reverse direction;

first memory means for storing a predetermined excitation phase of said pulse motor;

second memory means responsive to the drive pulses for storing a current excitation phase of said pulse motor; and control means for sequentially applying the drive pulses to the excitation phases of said pulse motor, beginning with the predetermined excitation phase, to cause said pulse motor to rotate in a desired direction and for comparing the contents of said first and second memory means at the cessation of application of the drive pulses to said pulse motor, wherein if the contents of said first and second memory means fail to coincide, said control means applies additional drive pulses to cause further rotation of said pulse motor in the desired direction until the contents of said first and second memory means coincide.

* * * * *

UNITED STATES PATENT AND TRADEMARK OFFICE

CERTIFICATE OF CORRECTION

PATENT NO. : 4,822,019

DATED : April 18, 1989

INVENTOR(S) : KEIJI NAGIRA

It is certified that error appears in the above-identified patent and that said Letters Patent is hereby corrected as shown below:

COLUMN 1

Line 66, "cut sheet," should read --cut sheets,--

COLUMN 2

Line 51, "hand," should read --hand, when--.
Line 62, "paper feed roller" should read --paper feed roller 7--.

COLUMN 3

Line 4, "printers," should read --printer,--.

COLUMN 4

Line 38, "stop S1," should read --step S1,--.

UNITED STATES PATENT AND TRADEMARK OFFICE

CERTIFICATE OF CORRECTION

PATENT NO. : 4,822,019

DATED : April 18, 1989

INVENTOR(S) : KEIJI NAGIRA

It is certified that error appears in the above-identified patent and that said Letters Patent is hereby corrected as shown below:

COLUMN 5

Line 39, "gear" should read --gears--.
Line 41, "larger" should read --a larger--.
Line 57, "excitation phase;" should read --excitation phases;--.

Signed and Sealed this

Sixteenth Day of January, 1990

*Attest:*

JEFFREY M. SAMUELS

*Attesting Officer*

*Acting Commissioner of Patents and Trademarks*